US005809881A

United States Patent [19]

Deschner et al.

[11] Patent Number: 5,809,881

[45] Date of Patent: Sep. 22, 1998

[54] FORM CYLINDER HAVING A GAP CLOSED BY A COVER ELEMENT HAVING A ROLLER MOUNTED THEREON

[75] Inventors: Jürgen Deschner, St. Leon-Rot; Ulrike Weisbrodt, Ilvesheim, both of Germany

[73] Assignee: Heidelberger Druckmaschinen AG, Heidelberg, Germany

[21] Appl. No.: 845,949

[22] Filed: Apr. 30, 1997

[30] Foreign Application Priority Data

Apr. 30, 1996 [DE] Germany ..... 196 17 217.9

[51] Int. Cl.[6] ..... B41L 11/08

[52] U.S. Cl. ..... 101/132; 101/142; 101/415.1

[58] Field of Search ..... 101/132, 142, 101/415.1; 451/491, 296

[56] References Cited

U.S. PATENT DOCUMENTS

| | | | |
|---|---|---|---|
| Re. 19,082 | 3/1934 | Lorentzen | 101/132 |
| 618,058 | 1/1899 | Crowell | 101/415.1 |
| 912,724 | 2/1909 | Pancoast | 101/415.1 |
| 4,217,824 | 8/1980 | Rebel et al. | 101/415.1 |
| 5,355,795 | 10/1994 | Moss et al. | 101/141 |
| 5,413,043 | 5/1995 | Fuhrmann et al. | 101/415.1 |
| 5,435,242 | 7/1995 | Kusch et al. | 101/142 |

FOREIGN PATENT DOCUMENTS 42 24 332 A1 1/1994 Germany .

*Primary Examiner*—Edgar S. Burr
*Assistant Examiner*—Leslie Grohusky
*Attorney, Agent, or Firm*—Herbert L. Lerner; Laurence A. Greenberg

[57] ABSTRACT

A printing-machine form cylinder having, in an interior space thereof, a winding reel and an unwinding reel for a printing film drawn around the outer casing surface of the form cylinder, respective ends of the printing film being fastened to the winding reel and the unwinding reel inside the form cylinder, the form cylinder being formed with a cylinder gap extending in the direction of a generatrix of the outer casing surface of the form cylinder, the cylinder gap being defined by cylinder gap edges which are formed on the form cylinder and around which the printing film is guidable into the interior of the form cylinder, includes a cover element closing the form cylinder gap, and at least one pressure roller disposed on the cover element and bearing against the printing film for guiding it out of the interior of the form cylinder over one of the cylinder gap edges.

3 Claims, 2 Drawing Sheets

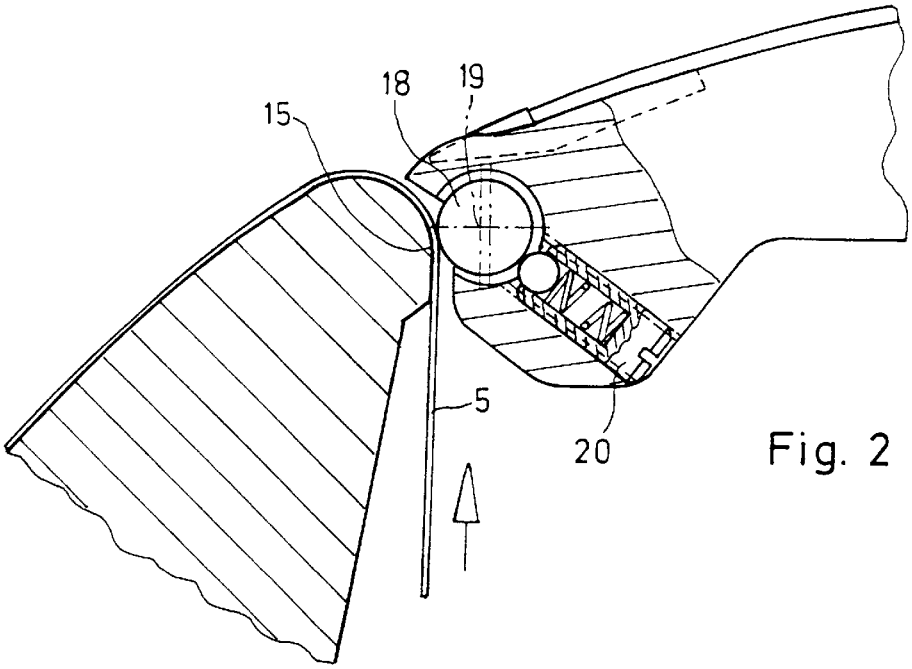
Fig. 2
Fig. 3
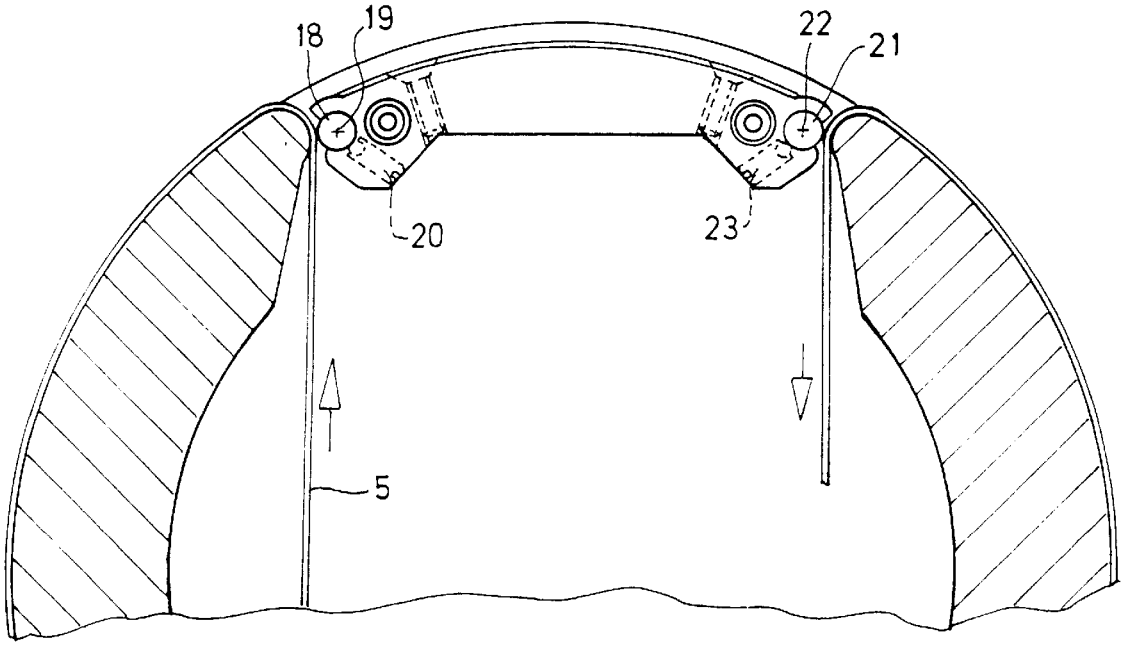

FORM CYLINDER HAVING A GAP CLOSED BY A COVER ELEMENT HAVING A ROLLER MOUNTED THEREON

BACKGROUND OF THE INVENTION

FIELD OF THE INVENTION

The invention relates to a form cylinder for a printing machine having as printing element a printing foil or film which is drawn onto the outer casing surface of the form cylinder.

Heretofore known form cylinders are formed with a channel or gap which extends at least over the width of the image to be printed. A winding reel and an unwinding reel for printing foil or film are arranged respectively in the cylinder gap and in the usually provided hollow interior of the form cylinder cavity which is accessible through the cylinder gap. Starting from the circumference of the unwinding reel, the printing film is guided over an edge of the cylinder gap and over the outer casing surface of the form cylinder. The printing film is led back over a further channel edge into the interior of the form cylinder onto the winding reel. The printing film may be provided with an image beforehand or after the film has been drawn onto the form cylinder. In order to avoid soiling of the imaging or image formation or of the printing film surface to be formed with the image and the parts located inside the form cylinder, it has become known heretofore to provide the cylinder gap with a covering which mainly allows only the passage of the film out of the gap and into the gap. In order to close the gap as tightly as possible, elastic sealing lips may be provided at the gap edges so that they lie on the surface of the printing film.

A disadvantage of the conventional form cylinders is that, when the printing film is being renewed with a fresh image on the outer casing surface of the form cylinder, the printing film slides along on the sealing lips. The printing film surface which is provided with an image or which is to be provided with an image is thereby damaged, which may lead to imaging errors and to misprints or printing faults.

SUMMARY OF THE INVENTION

It is accordingly an object of the invention to provide a printing-machine form cylinder having a printing gap with a covering which allows the printing film to pass through the gap between the covering and an edge of the gap without any damage.

With the foregoing and other objects in view, there is provided, in accordance with the invention, a printing-machine form cylinder having, in an interior space thereof, a winding reel and an unwinding reel for a printing film drawn around the outer casing surface of the form cylinder, respective ends of the printing film being fastened to the winding reel and the unwinding reel inside the form cylinder, the form cylinder being formed with a cylinder gap extending in the direction of a generatrix of the outer casing surface of the form cylinder, the cylinder gap being defined by cylinder gap edges which are formed on the form cylinder and around which the printing film is guidable into the interior of the form cylinder, comprising a cover element closing the form cylinder gap, and at least one pressure roller disposed on the cover element and bearing against the printing film for guiding it out of the interior of the form cylinder over one of the cylinder gap edges.

In accordance with another feature of the invention, the pressure roller is in spring-loaded engagement with the printing film.

In accordance with a concomitant feature of the invention, the form cylinder includes another pressure roller disposed on the cover element for bearing against the printing film as it is guided into the interior of the form cylinder over another of the cylinder gap edges.

An advantage afforded by the invention is that, while the printing film is being renewed on the outer surface of the form cylinder, the pressure roller or pressure rollers continue to roll on the surface of the form cylinder during the conveyance or advancement of the printing film. The rolling friction is so slight that the imaged surface, i.e., the surface provided with an image, or the surface to be provided with an image is not damaged. The pressure rollers bear constantly against the printing film, so that the tight sealing of the covering is assured. Furthermore, a smoothening effect on the printing film is achieved by the pressure rollers, so that the film rests exactly on the outer casing surface of the form cylinder and is wound neatly onto the winding reel, respectively.

The first exemplary embodiment of the invention having only one pressure roller, which is assigned to the cylinder gap edge over which the printing film is unwound, can be employed in those situations wherein the printing film is not to be used any further after the printing. The second exemplary embodiment of the invention having two pressure rollers, which are assigned, respectively, to different cylinder gap edges, can be employed in situations wherein the imaged printing film, i.e., the printing film formed with an image, is to be used again. In this regard, a reversal of the direction in which the printing film is drawn onto the outer casing surface of the form cylinder would be readily possible for the purpose of changing a printing image.

It is also possible, with respect to a cylinder gap edge, to provide two or more pressure rollers which, when connected in series or tandem, can improve the tight sealing effect of the covering.

Other features which are considered as characteristic for the invention are set forth in the appended claims.

Although the invention is illustrated and described herein as embodied in a form cylinder for a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

BRIEF DESCRIPTION OF THE DRAWINGS

FIG. 2 is an enlarged fragmentary view of FIG. 1 showing, in greater detail, how the spring loading is applied to the pressure roller; and FIG. 3 is a fragmentary view of FIG. 1 showing a different exemplary embodiment of the form roller which has two pressure rollers on the covering of the cylinder gap.

DESCRIPTION OF THE PREFERRED EMBODIMENTS

Figure 1:
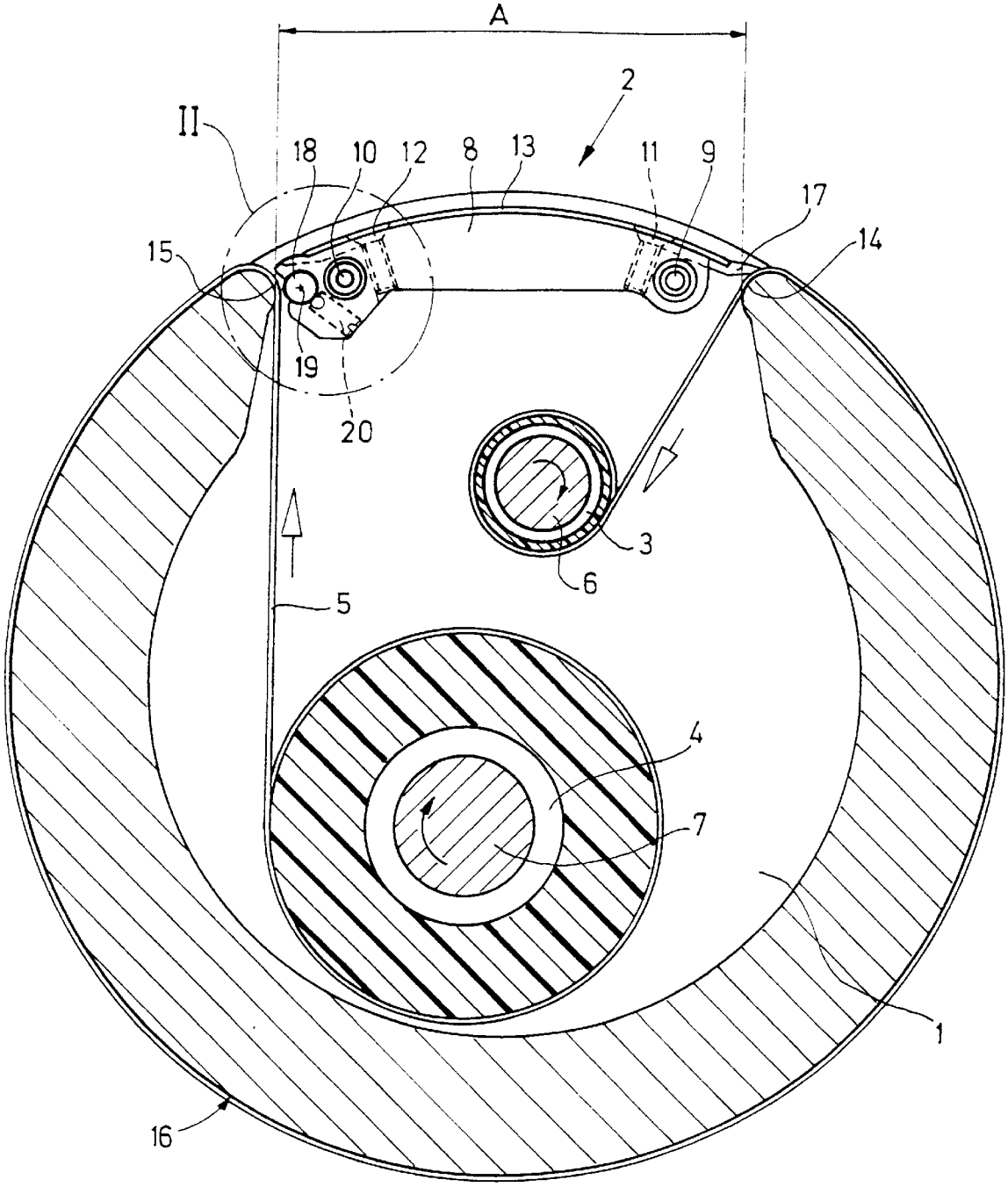
FIG. 1 is a cross-sectional view of an exemplary embodiment of the form cylinder according to the invention with a cylinder-gap covering having a sprung or spring-loaded pressure roller.

Referring now to the drawings and, first, particularly to FIG. 1 thereof, there is shown therein a form cylinder according to the invention, which is formed with a cavity 1 accessible via a cylinder gap or channel 2 having a width A. Respective winding and unwinding reels 3 and 4 for printing foil or film 5 are mounted in the cavity 1 on respective shafts 6 and 7. The shaft 6 is coupled to a non-illustrated conventional drive and the shaft 7 to a non-illustrated conventional braking mechanism. The cylinder gap 2 is provided with a covering which extends over the width A. The covering is formed of a frame 8 fastened by bolts 9 and 10 to end face parts of the form cylinder. A cover plate 13 is fastened to the frame 8 by screws 11 and 12. The printing film 5 is guided outwardly over an edge 15 of the form cylinder defining the cylinder gap 2 and is drawn onto the outer casing surface 16 of the form cylinder. An elastic sealing lip 17, which rests on the surface of the printing film 5, is provided on the frame 8 at a side of the cylinder gap 2 which faces towards a cylinder gap-defining edge 14 located opposite to the cylinder gap edge 15. As illustrated in greater detail in FIG. 2, a pressure roller 18 is provided in the covering frame 8 on that side of the cylinder gap 2 which faces towards the cylinder gap edge 15, the pressure roller 18 being disposed parallel to the cylinder gap edge 15 and being movable perpendicularly to the cylinder gap edge 15. For this purpose, bearings 19 of the pressure roller 18 are constructed to be displaceable within the frame 8. Thrust pieces 20 pressing against the bearings 19 bring the pressure roller 18 to bear against the printing film 5 which engages the cylinder gap edge 15.

When the winding reel 3 is driven via the shaft 6, printing film 5 is reeled off the unwinding reel 4. The printing film 5 is subjected to tension by braking the shaft 7. The printing film 5 slides over the respective cylinder gap edges 14 and over the outer cylindrical or casing surface 16 of the form cylinder. The sealing lip 17 and the pressure roller 18 directly engage the printing film 5, so that the elements located in the cavity 1 are shielded from the outside to the greatest extent possible. When the printing film 5 is being unrolled from the unwinding reel 4, the printing film 5 slides over the cylinder gap edge 15, and the pressure roller 18 rolls on the printing film 5. The transport speed of the printing film 5 and the circumferential speed of the pressure roller 18 are for the most part identical, so as to ensure slip-free rolling of the pressure roller 18. When the printing film 5 emerges from the cylinder gap 2, it is not damaged by the pressure roller 18. The pressure roller 18 produces a smoothening of the printing film 5 before the latter is drawn onto the outer casing surface 16 of the form roller, so that the printing film 5 rests flat on the outer casing surface 16 for the purpose of having an imaging or image forming operation performed thereon and for performing a subsequent printing operation therewith.

In constructions wherein it is intended that the printing film 5 be used again after a printing operation, a further pressure roller 21 may additionally be arranged in place of the sealing lip 17, as shown in greater detail in FIG. 3. As in the case of the pressure roller 18, the bearings 22 of the pressure roller 21 are subjected to force by thrust pieces 23 in such a manner that the pressure roller 21 bears against the printing film 5 running in the cylinder gap 2. Assurance is thereby provided that the image formed on the printing film 5 is not damaged by any sealing element during the running of the printing film into the cylinder gap 2.

We claim:

1. A printing-machine form cylinder having, in an interior space thereof, a winding reel and an unwinding reel for a printing film drawn around the outer casing surface of the form cylinder, respective ends of the printing film being fastened to the winding reel and the unwinding reel inside the form cylinder, the form cylinder being formed with a cylinder gap extending in the direction of a generatrix of the outer casing surface of the form cylinder, the cylinder gap being defined by cylinder gap edges which are formed on the form cylinder and around which the printing film is guidable into the interior of the form cylinder, comprising a cover element closing the form cylinder gap, and at least one pressure roller disposed on said cover element and bearing against the printing film for guiding it out of the interior of the form cylinder over one of the cylinder gap edges.

2. The form cylinder according to claim 1, wherein said pressure roller is in spring-loaded engagement with the printing film.

3. The form cylinder according to claim 1, including another pressure roller disposed on said cover element for bearing against the printing film as it is guided into the interior of the form cylinder over another of the cylinder gap edges.

* * * * *